US009194075B2

(12) United States Patent
Scarafiotti et al.

(10) Patent No.: US 9,194,075 B2
(45) Date of Patent: Nov. 24, 2015

(54) DRUM OF A MACHINE FOR TREATING LAUNDRY AND MACHINE HAVING SAID DRUM

(76) Inventors: Alberto Scarafiotti, Mappano Di Caselle (IT); Alessandro Scarafiotti, San Raffaele Cimena (IT)

( * ) Notice: Subject to any disclaimer, the term of this patent is extended or adjusted under 35 U.S.C. 154(b) by 463 days.

(21) Appl. No.: 13/521,401

(22) PCT Filed: May 14, 2010

(86) PCT No.: PCT/IB2010/052151
§ 371 (c)(1),
(2), (4) Date: Jul. 10, 2012

(87) PCT Pub. No.: WO2011/086428
PCT Pub. Date: Jul. 21, 2011

(65) Prior Publication Data
US 2012/0291497 A1 Nov. 22, 2012

(30) Foreign Application Priority Data
Jan. 15, 2010 (IT) ..... TO2010A0027

(51) Int. Cl.
*D06F 37/08* (2006.01)

(52) U.S. Cl.
CPC ..... *D06F 37/08* (2013.01)

(58) Field of Classification Search
CPC ..... D06F 37/08
See application file for complete search history.

(56) References Cited

U.S. PATENT DOCUMENTS

| | | | | |
|---|---|---|---|---|
| 1,762,665 | A * | 6/1930 | Paris | 68/143 |
| 1,887,971 | A * | 11/1932 | Wenger | 68/140 |
| 2005/0193500 | A1 | 9/2005 | Rhode et al. | |

FOREIGN PATENT DOCUMENTS

| | | | | |
|---|---|---|---|---|
| DE | 10034658 | A1 * | 7/2000 | D06F 33/02 |
| EP | 1 233 099 | | 8/2002 | |
| EP | 1233099 | A1 * | 8/2002 | D06F 37/08 |
| WO | WO 03/014454 | | 2/2003 | |

OTHER PUBLICATIONS

Written Opinion issued Sep. 22, 2010 in PCT Application No. PCT/IB2010/052151, filed May 14, 2010.
International Search Report issued Sep. 22, 2010 in PCT Application No. PCT/IB2010/052151, filed May 14, 2010.

* cited by examiner

*Primary Examiner* — Michael Barr
*Assistant Examiner* — Jason Riggleman
(74) *Attorney, Agent, or Firm* — Workman Nydegger

(57) ABSTRACT

A drum (1; 1') of a machine for treating laundry, in particular for washing and/or drying laundry, includes a substantially cylindrical shape and is rotatable about a substantially horizontal axis (X; X'). The drum includes a plurality of compartments (10; 10') having the shape of a circular crown sector, each compartment (10; 10') being adapted to contain at least one laundry item to be treated, so that a controlled mechanical action is exerted on the at least one laundry item.

13 Claims, 2 Drawing Sheets

DRUM OF A MACHINE FOR TREATING LAUNDRY AND MACHINE HAVING SAID DRUM

BACKGROUND OF THE INVENTION

1. Field of the Invention

The present invention relates to a drum of a machine for treating laundry furthermore, the present invention also relates to the associated machine for treating laundry.

2. Present State of the Art

Typically, the machines for treating laundry according to the present invention are washing machines, washing/drying machines and clothes dryers, and are therefore used for carrying out washing and/or drying processes on at least one laundry item.

It is known in the state of the art that such machines are provided with a rotary drum adapted to contain one or more laundry items to be treated.

When the machine is in operation, the drum rotates and the laundry items to be treated not only hits the inner surface of the drum, but also the other items present inside the drum; since the laundry items to be treated are soaked with water, their weight increases considerably and great stress is caused by torsion and compression of the laundry items themselves (textiles, manufactures, etc.) during their treatment. Such shocks and stresses cause damage to said laundry items, especially to those which are particularly delicate or which have a particular construction in terms of materials and dimensions (e.g. mattresses and pillows).

The parts of the laundry items under treatment which are most subject to damage may be rigid elements applied thereto, such as certain buttons and zippers, as well as other parts such as, for example, external embroidery or parts applied after the weaving stage.

Moreover, when the washing machine is in operation the lifters or paddles usually associated with the inner portion of the rotary drum drag the treated laundry, which may cause damage to the fibres of the most delicate textiles, especially when these are soaked with water and are therefore quite heavy.

So far, the manufacturers of household appliances have not paid particular attention to these damages.

SUMMARY OF THE INVENTION

The present invention is based on the recognition of the importance of these damages, also in the light of the constant decrease in the textile quality with which the modern articles are realized.

Clearly, on the one hand these problems are especially felt by customers becoming increasingly demanding, particularly in the richest countries, while on the other hand they have become more important due to articles being particularly delicate and expensive, or anyway suffering a decline in quality compared to those manufactured in the past.

Besides, the above-mentioned problems are particularly important when the laundry items to be treated are very large, like mattresses and pillows.

As a matter of fact, machines are known in the art which can wash mattresses "in line"; however, such machines take much room and are very expensive and poorly flexible, in that they can only treat that specific article.

Mattresses can nevertheless be washed in the traditional drums of known washing machines.

However, in addition to the aforementioned problem of damage caused to textiles and manufactures, washing mattresses in the traditional drums also poses further problems, since the hitting of the mattresses against the inner surface of the rotary drum and the considerable weight thereof necessarily throw the rotary drum significantly off balance.

This unbalance is especially important during the wash and spin cycles. It is due to the considerable weight of the mattress, especially when soaked with water; therefore, when the drum speed increases, the centrifugal force thus generated distributes the mattress (and therefore the weight thereof) in an uneven manner and concentrates it onto specific regions, thus creating an unbalance which increases with drum speed.

Rotary drum unbalance inevitably involves an increase in the noise produced by the washing machine, and may even cause damage to the washing machine, in particular to the balancing system thereof Furthermore, washing mattresses in the traditional washing machines' drums does not give optimum results, especially when the user tries to wash several mattresses simultaneously.

In fact, in such situations the mattresses are laid one onto the other inside the rotary drum, so that surfaces of different mattresses come in touch; this prevents the wash fluid from exerting an appropriate chemical and mechanical action for washing the items, in particular said contact surfaces, due to a sort of "sandwich effect".

In this frame, it is the main object of the present invention to overcome the above-mentioned drawbacks by providing a drum of a machine for treating laundry, as well as a machine thereof, so conceived as to ensure an effective washing of the laundry, especially when the laundry items to be treated have large dimensions, as is the case of mattresses.

It is another object of the present invention to provide a drum of a machine for treating laundry, and a machine thereof, so conceived as to eliminate, or at least significantly reduce, the risk of damaging the laundry items under treatment in the washing machine.

It is yet another object of the present invention to provide a drum of a machine for treating laundry, and a machine thereof, so conceived as to not cause unbalance of the rotary drum, in particular when said laundry items are soaked with wash fluid or during the spin cycles, and to not cause an increase in the noise produced by the washing machine or damage to the components of the washing machine, in particular to the balancing system thereof.

Said objects are achieved by the present invention through a drum of a machine for treating laundry, and a machine thereof, incorporating the features set out in the appended claims, which are intended as an integral part of the present description.

BRIEF DESCRIPTION OF THE DRAWINGS

Further objects, features and advantages of the present invention will become apparent from the following detailed description and from the annexed drawings, which are supplied by way of non-limiting example, wherein.

DETAILED DESCRIPTION OF THE PREFERRED EMBODIMENTS

Figure 1:
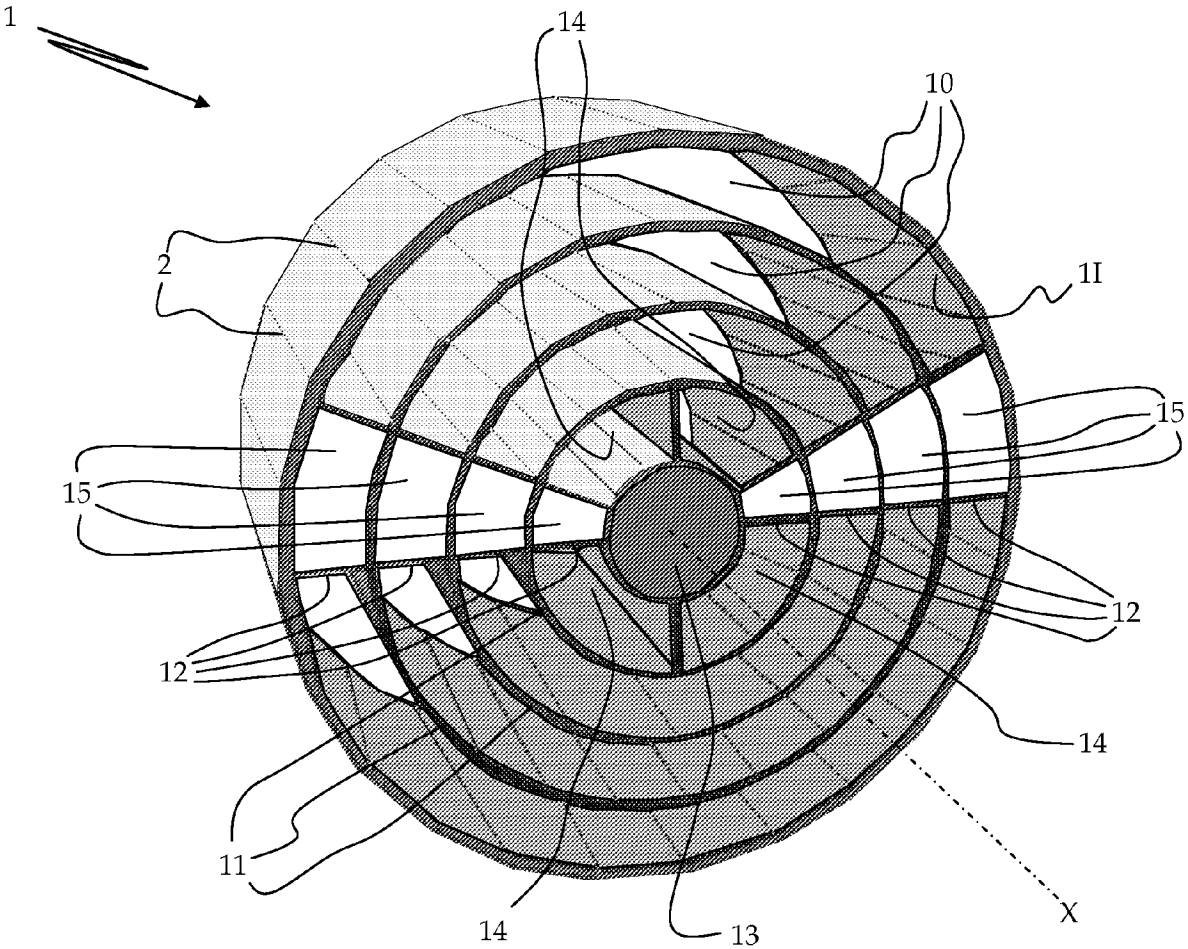
FIG. 1 is a perspective view of a first embodiment of a drum according to the present invention.

Referring now to the annexed FIG. 1, reference numeral 1 designates as a whole a drum of a machine for treating laundry, in particular for washing and/or drying said laundry, said machine not being shown in the annexed drawings.

The drum 1 according to the present invention has a substantially cylindrical shape and is rotatable about a substantially horizontal axis X; in FIG. 1, said axis X is represented by a dashed-dotted line.

As known in the state of the art, the drum 1 has a plurality of holes 2 for allowing the wash fluid contained in the tub (not shown in the drawings) of the laundry treating machine to flow through.

According to the present invention, said drum 1 comprises a plurality of compartments 10 having the shape of a circular crown sector, each compartment 10 being adapted to contain at least one laundry item to be treated, so that a controlled mechanical action is exerted on said at least one laundry item.

Said controlled mechanical action prevents said at least one laundry item under treatment from suffering any damage when the machine is in operation, in particular when said at least one laundry item is soaked with water and, as a consequence, is heavier than normal.

In fact, the circular crown sector shape of the plurality of compartments 10 provides control of the mechanical action exerted onto each item to be treated inside a compartment 10 because, when the machine is in operation, said at least one laundry item to be treated has limited freedom of movement within the compartment 10.

This is particularly true when said at least one item to be treated is very large, such as, for example, a mattress. In fact, in such a situation said at least one item to be treated inside the compartment 10 has limited freedom of movement:

- in the radial direction, i.e. from the axis of rotation X towards the outside of the drum 1 and vice versa;
- in the direction of rotation of the drum 1 and in the reverse direction.

Said limited freedom of movement of the item to be treated in the compartment 10 allows to safeguard the integrity of said at least one item precisely because the mechanical action exerted during the rotation of the drum 1 is controlled and does not change the characteristics of said at least one item, in particular the dimensional characteristics thereof.

Moreover, the fact of exerting a controlled mechanical action on said at least one item to be treated ensures a more effective washing of said at least one item, in that the controlled mechanical action can be exerted substantially on the whole surface of said at least one item and is added to the chemical action of the wash fluid, which typically contains detergents, softeners and the like.

It is also apparent that the drum 1 comprising a plurality of compartments 10 having a circular crown sector shape allows causing neither an unbalance of said drum 1, in particular when said at least one item under treatment is soaked with wash fluid or during the spin cycles, nor an increase in the noise produced by the machine as a consequence of the drum 1 getting off balance.

In order to create said compartments 10, the drum 1 internally comprises:

- at least one partition element 11 having a substantially cylindrical shape and being arranged concentrically within the drum 1;
- walls 12 which ensure that the size of each compartment 10 is approximately 180°.

Such a configuration of the compartments 10 allows the items to be treated to be distributed in an adequate manner when the machine according to the present invention is operating, in particular during the spin cycles carried out by said machine. In fact, the design of the compartments 10 with a size of approximately 180° allows said at least one item under treatment to be kept balanced during the operation of the machine according to the present invention, even when the speed of the drum 1 increases and the centrifugal force effect becomes particularly significant.

Preferably, said drum 1 is associated with an industrial machine, and comprises a plurality of partition elements 11 which are concentric relative to the drum 1, in particular said partition elements 11 being perforated in order to allow the wash fluid to flow through. As a consequence, the drum 1 according to the present invention is of a modular type, in that it may comprise a variable number of compartments 10 having a circular crown sector shape and a size of approximately 180°, said number depending on the desired size (in particular, the diameter) of said drum 1.

In a preferred embodiment, said walls 12 are arranged substantially radially in said drum 1 and are associated with an inner surface 1I of the drum 1 and with said at least one partition element 11.

Said drum 1 also comprises a core 13 for transmitting the rotary motion of said drum 1 about the axis X, the centre of said core 13 substantially coinciding with said axis X.

In addition, the drum 1 comprises a plurality of chambers 14, in particular adapted to contain small laundry items, said chambers 14 being obtained between said core 13 and a partition element 11. Preferably, said chambers 14 have a circular crown sector shape.

Preferably, said at least one item to be treated is loaded into the compartments 10 of the drum 1 frontally, in particular after a front door (not shown in FIG. 1) has been opened.

The drum 1 may also comprise a plurality of retaining elements 15, in particular of a movable type, which prevent said at least one laundry item to be treated from coming out of the compartments 10, e.g. when the machine according to the present invention is in operation; for example, said retaining elements 15 may be made of transparent material, so as to allow the laundry items inside the compartments 10 to be seen even when the treatment is under way.

Figure 2:
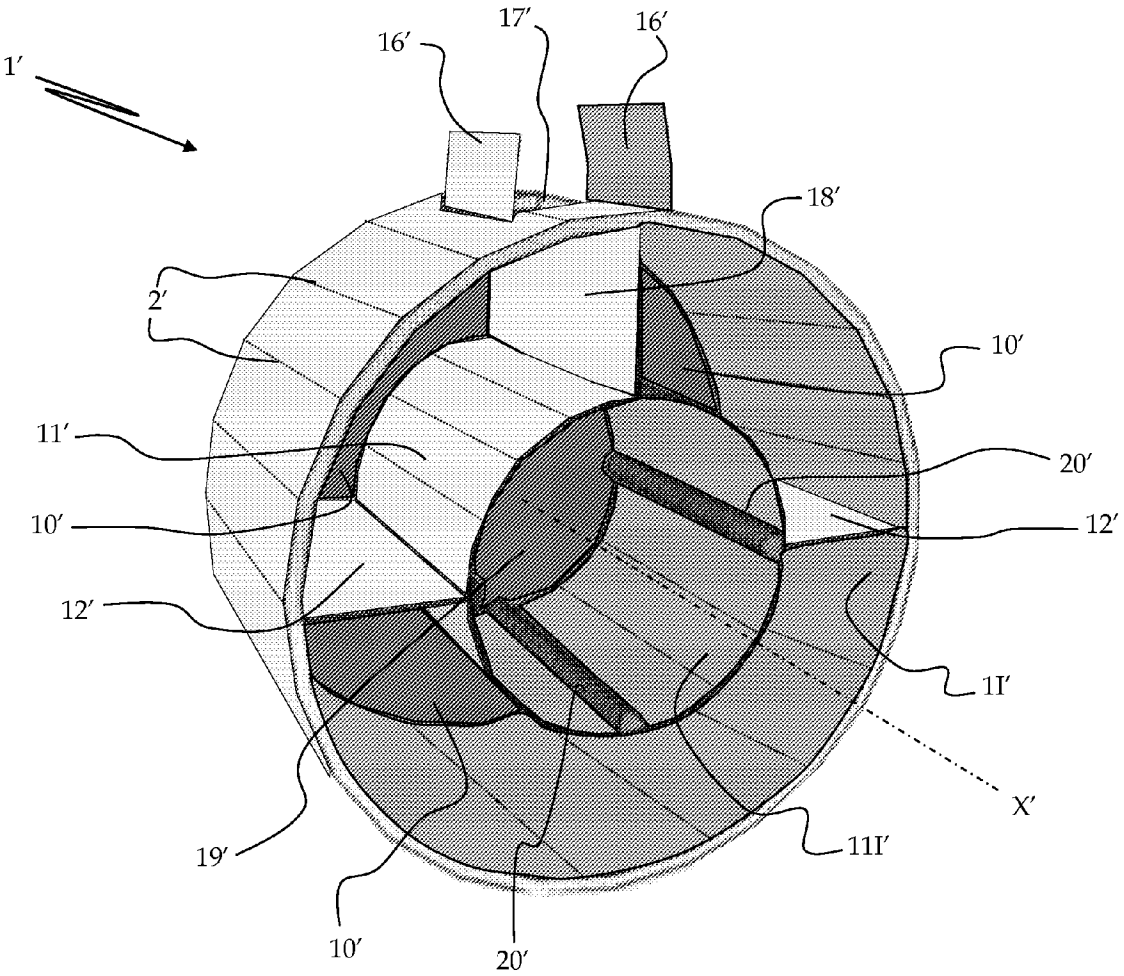
FIG. 2 is a perspective view of a second embodiment of a drum according to the present invention.

FIG. 2 is a perspective view of a second possible embodiment of a drum 1' according to the present invention.

The elements shown in FIG. 2 which are equivalent to those of FIG. 1 are designated by the same reference numerals with the addition of an apostrophe (e.g. the drum 1 of FIG. 1 is equivalent to the drum 1' of FIG. 2).

In this second embodiment as well, the drum 1':

- has a substantially cylindrical shape;
- is rotatable about a substantially horizontal axis X';
- has a plurality of holes 2' for allowing the wash fluid to flow through.

Likewise, in this second embodiment the drum 1' comprises a plurality of compartments 10' having the shape of a circular crown sector, each compartment 10' being adapted to contain at least one laundry item to be treated, so that a controlled mechanical action is exerted on said at least one laundry item.

It must be pointed out that the compartments 10' of FIG. 2 may have a limited radial extension (i.e. in the direction from the axis of rotation X' towards the outside of the drum 1 and vice versa), thus having dimensions suited to containing small, delicate laundry items; as a consequence, the dimensions and proportions of the compartments 10' may be different from those shown in FIG. 2.

In addition, the drum 1' comprises internally:

- at least one partition element 11' arranged concentrically within the drum 1', said at least one partition element 11' being perforated in order to allow the wash fluid to flow through;

walls 12' which ensure that the size of each compartment 10' is approximately 180°.

Preferably, said walls 12' are arranged substantially radially in said drum 1' and are associated with an inner surface 11' of the drum 1' and with said at least one partition element 11'.

Also the special configuration of the drum 1' allows the items under treatment to be distributed in an adequate manner when the machine according to the present invention is operating, in particular during the spin cycles carried out by said machine. In fact, the design of the compartments 10' with a size of approximately 180° allows said at least one item under treatment to be kept balanced during the operation of the machine according to the present invention, even when the speed of the drum 1' increases.

The drum 1' shown in FIG. 2 is associated with a household machine and comprises at least one door 16' secured to said drum 1' at an aperture 17' for providing access to the inside of the drum 1' and for loading said at least one laundry item to be treated from the top into the compartment 10' having the shape of a circular crown sector.

Preferably, said at least one door 16' is coupled to said drum 1' through a spring-loaded hinge, not shown in the drawing, which tends to open said door 16' outwards from the drum 1'. Also, said at least one door 16' comprises a pair of doors 16' secured to said drum 1' at two apertures 17' located on diametrically opposite sides of the drum 1', so as to allow access to the compartments 10' having a circular crown sector shape and a size of approximately 180°. It should be pointed out that FIG. 2 only shows one door 16' and one corresponding aperture 17', the other door 16' and the associated aperture 17' being substantially equal to those shown in FIG. 2.

In accordance with the present invention, the drum 1' comprises a removable septum 18' acting as a striker for said at least one door 16' and mechanically ensuring a correct closure of said at least one door 16'. The provision of the removable septum 8' also allows to change the shape of said compartments 10' having a circular crown sector shape, e.g. by subdividing one compartment 10' with a size of 180° into a pair of compartments 10' having each a size of 90°.

In a preferred embodiment, said septum 18' is associated with said at least one partition element 11' through fastening means (not shown in FIG. 2), which preferably comprise pins and holes suitable for providing a male-female coupling.

FIG. 2 also shows that an internal compartment 19' is obtained in said at least one partition element 11' where laundry can be treated independently of other laundry being treated in the plurality of compartments 10' having the shape of a circular crown sector.

In particular, in the internal compartment 19' it is possible to wash normal laundry items, essentially just like in the washing machine drums known in the art, while in the compartments 10' having the shape of a circular crown sector it is possible to wash delicate items.

As a result, thanks to the special design of the drum 1' according to the present invention, normal items and delicate items can advantageously be washed simultaneously without the risk of damaging said delicate items.

Preferably, said normal items are loaded into the internal compartment 19' of the drum 1' frontally, in particular after a front door (not shown in FIG. 2) has been opened.

Said internal compartment 19' further comprises a plurality of lifters 20' associated with the inner portion 11I' of said at least one partition element 11' for dragging the laundry items under treatment during the rotation of the drum 1'.

The advantages offered by a drum of a machine for treating laundry, in particular for washing and/or drying said laundry, according to the present invention are apparent from the above description.

In particular, by providing a drum 1, 1' comprising a plurality of compartments 10, 10' having the shape of a circular crown sector, wherein each compartment 10, 10' is adapted to contain one laundry item to be treated, a controlled mechanical action can be exerted on said laundry item without damaging it during the operation of the machine.

A further advantage is offered by the fact that the plurality of compartments 10, 10' having the shape of a circular crown sector ensures a more effective washing of said laundry item, since the controlled mechanical action can be exerted substantially on the whole surface of the item and is added to the chemical action of the wash fluid.

Another advantage provided by the special design of the plurality of compartments 10, 10' is that the laundry item to be treated causes no unbalance of the drum 1, 1' nor any increase in the noise produced by the drum 1, 1', in particular when the laundry item to be treated is soaked with a wash fluid or during the spin cycles. In particular, the optimum balance of the drum 1, 1' according to the present invention is also due to that fact that each of said compartments 10, 10' having the shape of a circular crown sector has a size of approximately 180°, which allows the treated items to be distributed in an adequate manner when the machine according to the present invention is in operation, in particular during the spin cycles carried out by said machine.

The drum and the machine for treating laundry described herein by way of example may be subject to many possible variations without departing from the novelty spirit of the inventive idea; it is also clear that in the practical implementation of the invention the illustrated details may have different shapes or be replaced with other technically equivalent elements.

It can therefore be easily understood that the present invention is not limited to the above-described drum and machine for treating laundry, but may be subject to many modifications, improvements or replacements of equivalent parts and elements without departing from the inventive idea, as clearly specified in the following claims.

The invention claimed is:

1. A washing machine for treating laundry, said washing machine comprising:

a housing;

a tub disposed inside of said housing;

a front door attached to a front of said housing; and a drum arranged inside said tub and configured to rotate about a horizontal axis, said drum comprising:

an outer wall having a cylindrical shape and being rotatable about the horizontal axis;

a plurality of first walls arranged concentrically inside the outer wall, wherein each of the first walls has a cylindrical shape and completely encircles the horizontal axis;

a plurality of second walls;

a plurality of compartments defined by the plurality of first walls and the plurality of second walls, each compartment having a circular crown sector shape, each compartment being adapted to contain at least one laundry item to be treated, so that a controlled mechanical action is exerted on said at least one laundry item, wherein each of the plurality of compartments includes an opening that is arranged to face the front door when the front door is closed such that the at least one laundry item can be loaded into the plurality of compartments when the front door is open.

2. The washing machine according to claim 1, wherein said drum is associated with an industrial machine and said outer wall and said plurality of first walls are perforated in order to allow a wash fluid to flow through the outer wall and plurality of first walls.

3. The washing machine according to claim 1, wherein the plurality of second walls extend between the outer wall and at least one of the first walls, the plurality of second walls placed such that each compartment extends over an angle of approximately 180° around the horizontal axis.

4. The washing machine according to claim 1, further comprising means for transmitting a rotary motion to said drum, the drum further comprising a core, wherein the means for transmitting a rotary motion causes the drum to rotate about the core, wherein the horizontal axis passes through the core.

5. The washing machine according to claim 4, further comprising a plurality of chambers adapted to contain small laundry items to be treated, said chambers being disposed between said core and the plurality of first walls.

6. The washing machine according to claim 1, further comprising a plurality of movable retaining elements arranged on the plurality of first walls to cover a portion of the openings of the compartments and configured to prevent the at least one laundry item to be treated from coming out of any one of the plurality of compartments.

7. The washing machine according to claim 1, wherein the drum is associated with a household machine, said outer wall including an aperture, said drum further comprising at least one door secured to said outer wall at the aperture, the aperture enabling loading at least one laundry item to be treated into one of the plurality of compartments having the shape of a circular crown sector.

8. The washing machine according to claim 7, further comprising a removable septum to change the shape of said one of the plurality of compartments, said septum acting as a striker for said at least one door.

9. The washing machine according to claim 6, wherein an internal compartment located in a center portion of the drum is defined by an inner wall included in the plurality of first walls, where laundry can be treated in the internal compartment independently of other laundry being treated in the plurality of compartments that each have a circular crown sector shape.

10. The washing machine according to claim 9, wherein said internal compartment comprises a plurality of lifters, the plurality of lifters arranged on a surface of the inner wall.

11. The washing machine according to claim 3, wherein said plurality of second walls are arranged radially from the horizontal axis.

12. The washing machine according to claim 7, wherein said septum is associated with at least one of the plurality of first walls through fasteners which comprise pins and holes suitable for providing a male-female coupling.

13. The washing machine according to claim 1, wherein the plurality of first walls are radially spaced apart in the drum.

* * * * *